US008016563B1

(12) United States Patent
Liang

(10) Patent No.: US 8,016,563 B1
(45) Date of Patent: Sep. 13, 2011

(54) TURBINE BLADE WITH TIP TURN COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 934 days.

(21) Appl. No.: 12/004,946

(22) Filed: Dec. 21, 2007

(51) Int. Cl.
*F01D 5/18* (2006.01)

(52) U.S. Cl. ..... 416/97 R

(58) Field of Classification Search ..... 415/115; 416/90 R, 92, 96 R, 96 A, 97 R
See application file for complete search history.

(56) References Cited

U.S. PATENT DOCUMENTS 4,474,532 A * 10/1984 Pazder ..... 416/97 R
6,241,466 B1 * 6/2001 Tung et al. ..... 415/115
6,960,060 B2 * 11/2005 Lee ..... 415/115
7,014,424 B2 * 3/2006 Cunha et al. ..... 416/97 R
7,186,082 B2 * 3/2007 Mongillo et al. ..... 416/97 R
7,217,095 B2 * 5/2007 Pietraszkiewicz et al. . 416/97 R
2002/0119047 A1 * 8/2002 Starkweather ..... 416/97 R
2005/0008487 A1 * 1/2005 Lee et al. ..... 416/97 R
2006/0222493 A1 * 10/2006 Liang ..... 416/97 R
2007/0081894 A1 * 4/2007 Garner ..... 416/97 R
2009/0155088 A1 * 6/2009 Lee et al. ..... 416/90 R

* cited by examiner

*Primary Examiner* — Christopher Verdier
(74) *Attorney, Agent, or Firm* — John Ryznic

(57) ABSTRACT

A turbine blade with a conical shaped tip for use in a first or second stage of a turbine. The airfoil includes an aft flowing 3-pass serpentine flow cooling circuit with a serpentine tip turn located between the first and the second legs and underneath the tip. Mini serpentine flow cooling circuits are formed in the end of the first leg and the beginning of the second leg to reduce or eliminate the cooling flow separation and over temperature issues at the tip portion of the blade. A leading edge cooling supply channel is located forward of the first leg and has a decreasing flow area with an exit cooling hole at the tip to discharge cooling air. The last leg of the main serpentine circuit is formed by a slanted rib that produces a decreasing flow area in the last leg and includes an exit cooling hole on the tip to discharge cooling air. The last leg is connected to a row of exit cooling holes or slots formed along the trailing edge of the airfoil. The main serpentine flow circuit is separated from the leading edge cooling channel so that no cooling air mixes.

9 Claims, 3 Drawing Sheets

View A-A

View B-B

TURBINE BLADE WITH TIP TURN COOLING

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to a turbine blade with a conical tip.

2. Description of the Related Art Including Information Disclosed Under 37 CFR 1.97 and 1.98

A gas turbine engine includes a compressor to compress air, a combustor to burn the compressed air with a fuel and produce a high temperature gas flow, and a turbine to convert the energy from the high temperature gas flow into mechanical energy used to drive the compressor and, in the case of an aero engine to drive a bypass fan, or in the case of an industrial gas turbine (IGT) engine to drive an electric generator.

The efficiency of the engine can be increased by passing a higher temperature gas flow into the turbine. However, the inlet temperature of the turbine is limited to the material properties of the first stage blades and vanes. Higher inlet turbine temperatures can be obtained by a combination of material properties (allowing for higher melting temperatures) and improved airfoil cooling. Since the compressed air used for airfoil cooling is bled off from the compressor, maximizing the amount of cooling while minimizing the amount of cooling air used is a major objective for the engine designer.

In a conical blade with cooling circuit, a serpentine tip turn will likely experience flow separation and recirculation issues. As a consequence of this, over temperatures occur at the locations of the blade tip turn regions corresponding to the flow separation. FIG. 1 shows a cut-away view of an aft flowing triple pass all convectively cooled turbine blade of the prior art. FIG. 2 shows a cross sectional view taken along the line A-A of the blade in FIG. 1. In the convectional cooling circuit of FIG. 1, the blade leading edge is cooled with a directed feed single pass radial flow channel. The leading edge cooling passage, in general, has a rough triangular shape as seen in FIG. 2 due to the narrowing of the airfoil wall at the leading edge. The inner surface area of the leading edge cooling passage reduces to the apex of an acute angle. The distribution of the cooling flow to the leading edge corner decreases and the substantial flow velocity as well as the internal heat transfer coefficient is reduced.

An alternative way to improve the airfoil leading edge cooling effectiveness while maintaining the same basic cooling circuit with the same amount of cooling flow is by the reduction of the airfoil leading edge cavity through flow area which increases the channel through flow velocity and therefore the resulting internal heat transfer coefficient. This is done by repositioning the leading edge rib forward as shown in FIG. 3. As a result of this modification, the blade tip turn cooling flow area ratio increases and yields a large unsupported mid-chord tip turn flow channel. The net impact due to this geometry change will enhance the blade tip turn flow separation and recirculation issues, especially for a blade with a conical tip design. As a consequence though, this design induces a higher blade tip turn loss and over temperature occurs at the location of the blade tip turn regions corresponding to the flow separation. This separation problem becomes even more pronounced for a blade with a conical tip. In addition, an increase of the airfoil mid-chord downward flowing channel flow area will reduce the through flow velocity and lower the internal heat transfer coefficient. Internal flow separation may occur for the mid-chord flow channel as well as the tip turn region when the internal Mach number is too low.

BRIEF SUMMARY OF THE INVENTION

It is an object of the present invention to provide for a first or second stage turbine blade with a serpentine cooling circuit in the mid-chord region.

It is another object of the present invention to provide for a turbine blade with a triple pass serpentine circuit for a conical tip blade with a low tapered airfoil or wide open tip turn geometry.

DETAILED DESCRIPTION OF THE INVENTION

Figure 1:
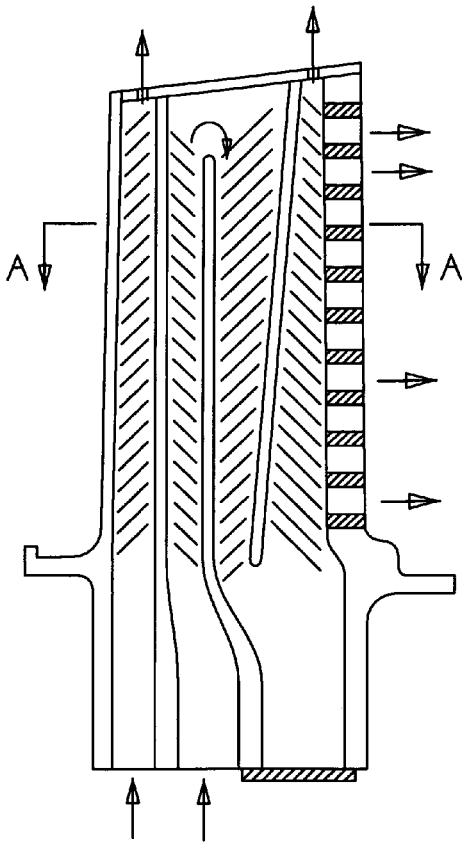
Fig 1 Prior Art
FIG. 1 shows cut-away view of the front of a prior art conical tip shaped turbine blade.
Figure 2:
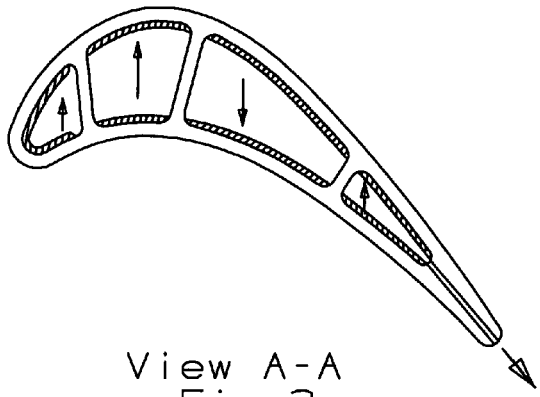
Fig 2 Prior Art
FIG. 2 shows a cross sectional view of the turbine blade through line A-A in FIG. 1.
Figure 3:
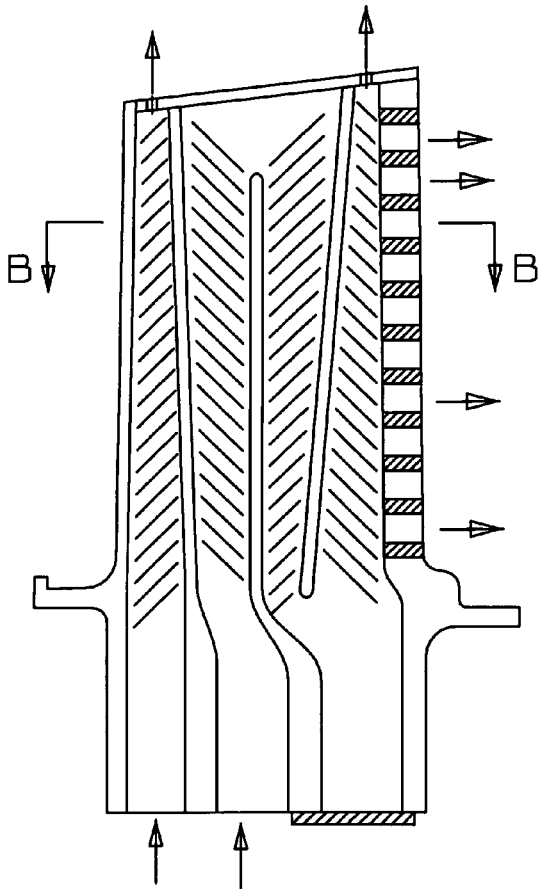
Fig 3 Prior Art
FIG. 3 shows a cut-away view of the front of a prior art blade with a reduced leading edge flow area.
Figure 4:
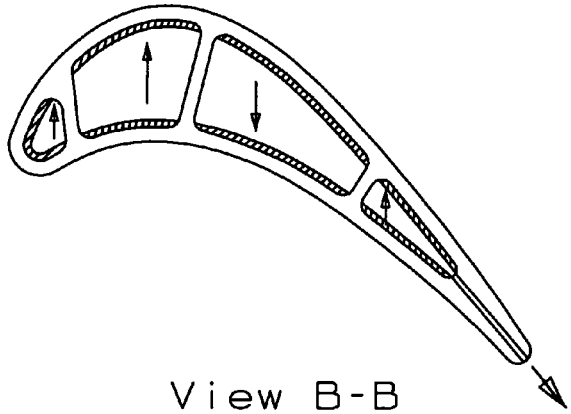
Fig 4 Prior Art
FIG. 4 shows a cross sectional view of the turbine blade through the line B-B in FIG. 3.
Figure 5:
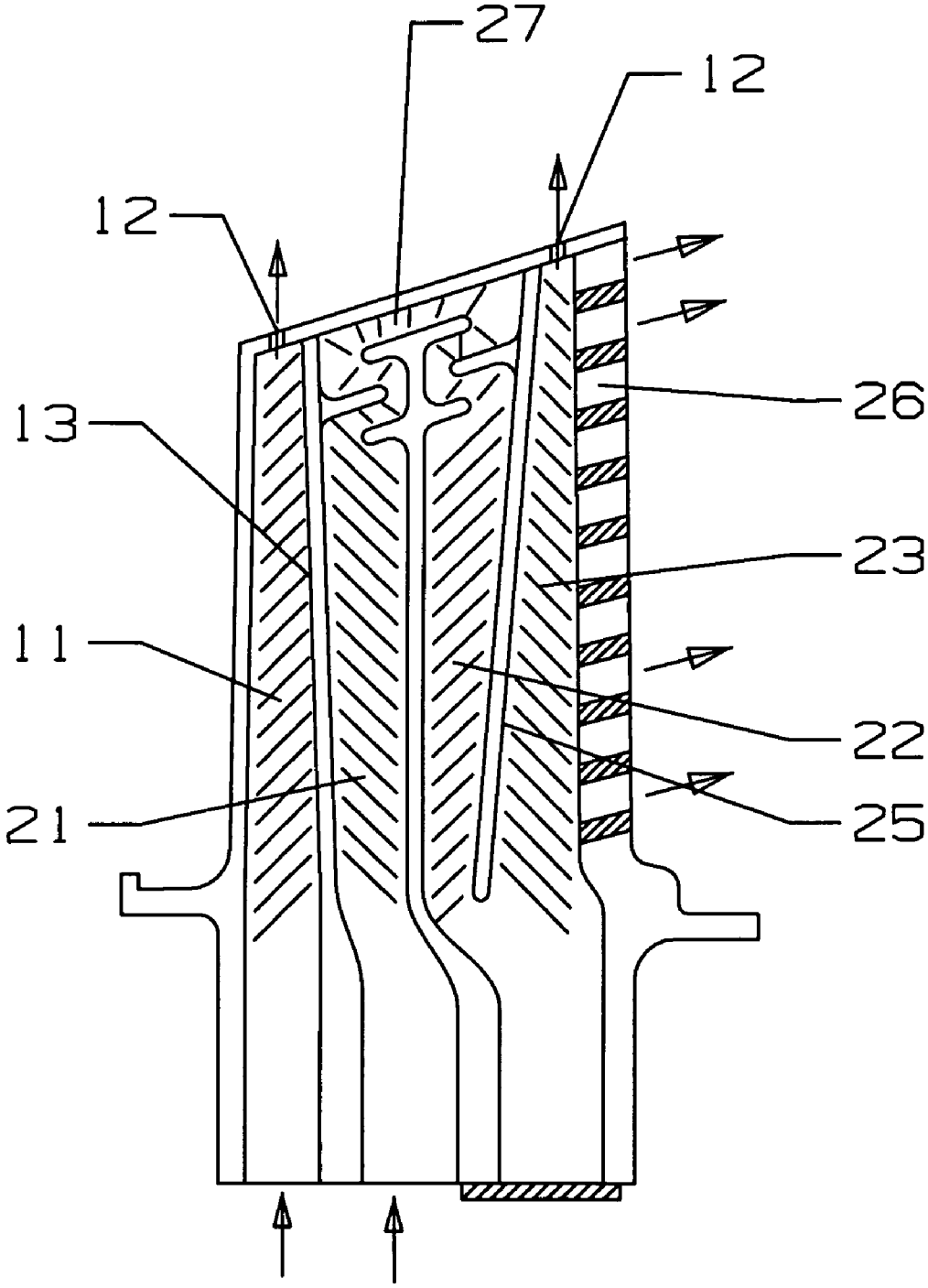
FIG. 5 shows a cut-away view of the front of the turbine blade of the present invention.

The above described cooling flow separation and over temperature issues can be reduced or eliminated by the incorporation of the additional serpentine cooling flow circuit geometry of the present invention into the prior art tip turn cooling flow serpentine channel as shown in FIG. 5. These multiple pass axial mini flowing serpentine cooling flow networks will eliminate the blade tip section turn region and mid-chord section flow separation issues and therefore greatly enhance the tip region cooling while providing the blade mid-chord section with adequate cooling and structural support.

The turbine blade in FIG. 5 includes a leading edge cooling channel 11 extending from the root inlet to the tip, a tip exit hole 12 to discharge cooling air from the channel 11, and a slanted rib 13 that slants toward the leading edge side in order to decrease the flow area within the channel 11 in the direction toward the tip. A three pass aft flowing serpentine flow cooling circuit (the main 3-pass serpentine flow circuit) is located aft of the leading edge channel 11 and includes a first leg 21, a second leg 22 and a third leg 23 connected in series in the direction of cooling air flow. The second leg 22 and the third leg 23 are separated by a slanted rib 25 that forms a decreasing flow area for each of the two legs 22 and 23. A row of cooling air exit slots or holes 26 is arranged along the trailing edge of the blade and is connected to the third leg 23. A tip exit hole 12 is also located at the end of the third leg 23 to discharge cooling air onto the tip surface. A serpentine tip turn 27 is located under the tip and connects the second leg 22 to the third leg 23.

An arrangement of ribs is formed within the first and second legs 21 and 22 in the tip region of the airfoil to produce a mini 3-pass serpentine flow circuit in each of these legs. The first mini 3-pass serpentine flow cooling circuit is located at the end of the first leg 21. The second mini 3-pass serpentine flow cooling circuit is located at the beginning of the second leg 22. The serpentine tip turn 27 is located between these two mini 3-pass serpentine flow circuits. The first mini 3-pass serpentine circuit flows from the first leg 21 of the main serpentine circuit and into the serpentine tip turn 27. The second mini 3-pass serpentine circuit flows from the tip turn 27 and into the second leg 22 of the main serpentine circuit. The mini serpentine flow circuits are shown as 3-pass serpentines. However, one or both can have more than 3 passes if the situation warrants it. The main serpentine flow circuit does not have any film cooling holes to discharge film cooling air onto external walls of the airfoil.

In operation, cooling flow channels through the first leg 21 of the mid-chord 3-pass serpentine flow channel at high velocity which generates a high rate of internal heat transfer coefficient. This cooling flow then serpentines through the axial flow serpentine passage 27 located in the airfoil tip turn section. The total amount of cooling air is then accelerated to the outer section of the blade tip turn and the turn corners will receive more of the free stream cooling flow. This cooling flow arrangement will eliminate the cooling flow separation problem at the outer portion of the tip turn and provide effective cooling for that particular region. In addition, the cooling air is first impinged onto the forward corner of the tip turn and then is impinged onto the aft corner of the tip turn prior to exiting from the tip turn flow channel 27. The combination of effects due to the impingement cooling and multiple elbow turns greatly improves the blade outer tip region cooling.

The cooling air then flows through the second leg 22 in the airfoil mid-chord section to provide cooling for the blade mid-chord section, and then through the third leg 23 of the serpentine flow circuit to provide cooling for the trailing edge region. Cooling air is progressively bled off from the third leg 23 and through the trailing edge holes 26 to provide cooling for the trailing edge corner.

I claim the following:

1. An air cooled turbine airfoil comprising:

a main serpentine flow cooling circuit formed within the airfoil and having at least three legs;

the first leg of the serpentine being separated from the second leg by a rib;

the first leg being connected to the second leg by a tip turn formed underneath the airfoil tip; and, the end of the first leg and the beginning of the second leg both having a radial mini serpentine flow circuit.

2. The air cooled turbine airfoil of claim 1, and further comprising:

the airfoil is a rotor blade and the tip is conical in shape.

3. The air cooled turbine airfoil of claim 1, and further comprising:

the two mini serpentine flow circuits are each 3-pass serpentine circuits.

4. The air cooled turbine airfoil of claim 1, and further comprising:

the main serpentine flow circuit is a 3-pass serpentine circuit; and, the last leg of the main serpentine circuit is formed by a slanted rib such that the flow area decreases in the direction toward the tip.

5. The air cooled turbine airfoil of claim 1, and further comprising:

the main serpentine flow circuit is an aft flowing serpentine circuit.

6. The air cooled turbine airfoil of claim 1, and further comprising:

a leading edge cooling channel separated from the first leg of the main serpentine circuit by a slanted rib, the rib slanting toward the leading edge such that the flow area in the leading edge channel decreases in the direction toward the tip.

7. The air cooled turbine airfoil of claim 6, and further comprising:

a tip exit cooling hole at the end of the leading edge cooling channel to discharge cooling air.

8. The air cooled turbine airfoil of claim 1, and further comprising:

a row of exit cooling holes along the trailing edge and connected to the third leg of the main serpentine to discharge cooling air from the third leg.

9. The air cooled turbine airfoil of claim 1, and further comprising:

the main serpentine flow circuit does not have any film cooling holes to discharge film cooling air onto external walls of the airfoil.

* * * * *